US009810416B2

(12) United States Patent
Chen et al.

(10) Patent No.: US 9,810,416 B2
(45) Date of Patent: Nov. 7, 2017

(54) METHOD FOR MANUFACTURING A LAMP-HOUSING-TYPE HEAT-SINK, LAMP-HOUSING-TYPE HEAT-SINK, AND LED LIGHTING DEVICE

(71) Applicant: HANGZHOU HPWINNER OPTO CORPORATION, Zhejiang (CN)

(72) Inventors: Kai Chen, Zhejiang (CN); Jianming Huang, Zhejiang (CN); Huali Lu, Zhejiang (CN)

(73) Assignee: HANGZHOU HPWINNER OPTO CORPORATION, Hangzhou, Zhejiang (CN)

( * ) Notice: Subject to any disclaimer, the term of this patent is extended or adjusted under 35 U.S.C. 154(b) by 514 days.

(21) Appl. No.: 14/354,535

(22) PCT Filed: Sep. 20, 2012

(86) PCT No.: PCT/CN2012/081647

§ 371 (c)(1),
(2) Date: Apr. 25, 2014

(87) PCT Pub. No.: WO2013/060211

PCT Pub. Date: May 2, 2013

(65) Prior Publication Data

US 2014/0247609 A1 Sep. 4, 2014

(30) Foreign Application Priority Data

Oct. 26, 2011 (CN) ..... 2011 1 0329640
Oct. 26, 2011 (CN) ..... 2011 2 0413445 U

(51) Int. Cl.
*F21V 29/00* (2015.01)
*F21K 9/90* (2016.01)
(Continued)

(52) U.S. Cl.
CPC ..... *F21V 29/22* (2013.01); *B21D 51/16* (2013.01); *F21K 9/90* (2013.01); *F21V 29/89* (2015.01); *Y10T 29/49117* (2015.01)

(58) Field of Classification Search
CPC ..... B21D 51/16; B21D 22/20; B21D 22/28; B21D 28/02; B21D 28/22; F21V 29/22
(Continued)

(56) References Cited

U.S. PATENT DOCUMENTS 4,320,645 A * 3/1982 Stanley ..... B21D 28/22 174/DIG. 20
2010/0001648 A1* 1/2010 De Clercq ..... H05B 33/0821 315/113
(Continued)

FOREIGN PATENT DOCUMENTS

CN 1045043 A 9/1990
CN 101091976 A 12/2007
(Continued)

*Primary Examiner* — Sean Gramling
*Assistant Examiner* — Gerald J Sufleta, II
(74) *Attorney, Agent, or Firm* — Muncy, Geissler, Olds & Lowe, P.C.

(57) ABSTRACT

A lamp-housing-type heat-sink in an LED lighting device is provided, which is a hollow middle part formed monolithically by extending a high purity aluminum plate with a thickness of 0.5 mm to 5 mm and an aluminum content of above 95%. The heat-sink has a heat-sinking surface and housing body. A surface contact structure is formed between the heat-sinking surface and a circuit board, and several radiating holes are set on the housing body to form heat dissipation channels. A method for manufacturing the lamp-housing-type heat-sink in LED lighting device is also provided. The lamp-housing-type heat-sink uses fewer materi-
(Continued)

als and costs less than conventional die-cast aluminum housing, while providing a higher thermal conductivity co-efficient.

16 Claims, 13 Drawing Sheets

(51) Int. Cl.
*B21D 51/16* (2006.01)
*F21V 29/89* (2015.01)

(58) Field of Classification Search
USPC ..... 72/337, 347–348
See application file for complete search history.

(56) References Cited

U.S. PATENT DOCUMENTS

2011/0017496 A1* 1/2011 Hayashi ..... H01L 23/3735
174/252
2012/0315411 A1* 12/2012 Castelle ..... B32B 1/08
428/34.1

FOREIGN PATENT DOCUMENTS

| | | | |
|---|---|---|---|
| CN | 101314172 | A | 12/2008 |
| CN | 201190931 | Y | 2/2009 |
| CN | 201396599 | Y | 2/2010 |
| CN | 201795450 | U | 4/2011 |
| CN | 201902888 | U | 7/2011 |
| CN | 201909295 | U | 7/2011 |
| CN | 201983238 | U | 9/2011 |
| CN | 202328091 | U | 7/2012 |
| EP | 0 740 971 | A1 | 11/1996 |

* cited by examiner

METHOD FOR MANUFACTURING A LAMP-HOUSING-TYPE HEAT-SINK, LAMP-HOUSING-TYPE HEAT-SINK, AND LED LIGHTING DEVICE

BACKGROUND OF THE INVENTION

Field of the Invention

The invention relates to the field of illumination and, in particular, to a method for manufacturing a lamp-housing-type heat-sink, a lamp-housing-type heat-sink, and an LED lighting device.

Brief Description of the Related Art

Luminous efficiency is only around 10 lm/W for a traditional filament lamp, and about 30 lm/W for halide torches. Most of the electric energy is transformed into heat and dissipated, which causes a huge waste of electric energy. LED is a new semiconductor lighting technology, and the luminous efficiency of LED beads on the market can reach 120 lm/W and above. With excellent power supply and reasonable structure design, the luminous efficiency of an LED lamp can be over 90 lm/W. In this way, an LED lamp of 7 W to 9 W can replace a traditional filament lamp of 60 W and, thus, a lot of electric energy can be saved.

The common LED bulb, LED spotlight, and LED PAR lamp, etc. on the market are composed of a die-cast aluminum heat-sink, a semispherical diffuser or lens module, a circuit board with welded LED beads, an LED driving power, and a lamp base, etc. The circuit board is fixed on the die-cast aluminum heat-sink with a diffuser or lens module covered above, and there is a hollow cavity in the die-cast aluminum heat-sink in which LED driving power is installed.

In CN 201020220556.9, an LED bulb heat-sink and LED bulb are disclosed. The LED bulb heat-sink includes a heat transmission part on the top, a heat dissipation part in the side, and a positioning part in the bottom. The heat dissipation part includes several longitudinal heat radiation strips. The top ends of the heat radiation strips are connected with the heat transmission part, and the bottom ends form the positioning part. Spaces are reserved between the heat radiation strips. Although this provides a heat dissipation effect to some extent, it is economically inefficient for the non-integrated structure.

In CN 201020666630.X, a type of bulb is disclosed which includes a diffuser and lamp base that can be connected to the power, as well as a heat-sink set between the lamp base and the diffuser. A hollow cavity is set between the heat-sink for air flow, and spaces are also set at the two ends of the heat-sink for air flow. This invention is especially characterized by the hollow cavity and spaces in the heat-sink for air flow, which will take away the heat within the heat-sink to accelerate the heat dissipation.

In CN 201120086659.5, a type of LED bulb heat-sink is disclosed. The heat-sink is a one-piece structure with a main body and heat dissipation platform. The main body is hollow with several holes for thermal convection. The heat-sink is applied to energy-saving LED bulbs. The main body is an important part of the bulb appearance as well as the heat dissipation part of the LED. With materials of aluminum of high heat conductivity and the design of passive natural air flow heat dissipation, the heat dissipation efficiency of the lamp has been improved. Even with improved heat dissipation efficiency, this heat-sink is made of die-cast aluminum which is material consuming and leads to high weight and cost. The thermal conductivity of die-cast aluminum is about 88% and the heat dissipation efficiency is not satisfactory. In particular, this heat-sink includes an internal wall and an external wall. Strip holes for heat dissipation are arranged in parallel and radial directions on the external wall to form channels with multiple holes on the heat dissipation platform, so as to theoretically transmit the heat on the circuit board. However, since the circuit board is tightly close to the heat dissipation platform, the heat of the circuit board will be conducted to the space formed by the internal walls through the heat dissipation platform of die-cast aluminum and mutually affect heat from the power supply within the internal space.

In conclusion, the existing LED lighting devices have the following disadvantages:

First, the cost of the lamp housing, whether of traditional die-cast aluminum or aluminum of high heat conductivity as discussed above, is relatively high, accounting for over 30% of the whole. Moreover, the weight thereof is large with the conventional thickness, which will directly determine the weight of the whole LED bulb. This makes it difficult to decrease the weight of the whole LED bulb.

Second, the power supply of the lamp usually is confined within a plastic housing that is within the hollow cavity of the aluminum housing. The heat of the circuit board will be conducted to the hollow cavity of the aluminum housing, which will make the heat of the power supply and heat dissipation part affect each other and increase the internal temperature of the power supply. This will lead to power supply damage. Based on actual measurement, the temperature of the power supply can be over 80°.

Also, the housing includes an internal wall and an external wall, which makes the fabrication complex and increases weight and cost.

Additionally, the manufacturing of the housing of the existing LED lighting devices is complicated.

BRIEF SUMMARY OF THE INVENTION

The invention provides a method for manufacturing a lamp-housing-type heat-sink in an LED lighting device to resolve the technical problems in existing LED lighting devices, including high weight, poor heat dissipation efficiency, and high cost.

A second purpose of the present invention is to provide a lamp-housing-type heat-sink in an LED lighting device to resolve the technical problems in existing LED lighting devices, including high weight, poor heat dissipation efficiency, and high cost.

A third purpose of the present invention is to provide an LED lighting device to resolve the technical problems in existing LED lighting devices, including high weight, poor heat dissipation efficiency, and high cost.

The method for manufacturing a lamp-housing-type heat-sink in an LED lighting device includes the following steps:

(1) Blank: Take an aluminum plate with a thickness of 0.5 mm to 5 mm and an aluminum content of over 95% as per the pre-designed size, and blank the plate to an external profile needed by the housing;

(2) Deep Extend: Extend the plate into an open and hollow workblank;

(3) Neck down: Put the extended workblank into a necking die to neck down to the preset radian of the lamp-housing-type heat-sink.

Preferably, between Step (1) and Step (2), the method also includes:

First type punch forming: In the middle of the plate, punch out a sinking area used to contact the surface of a circuit board, and an abutted surface tightly fitting the LED circuit board is formed in the sinking area.

Preferably, between Step (1) and Step (2), the method also includes:

Second type punch forming: In the middle of the plate, punch out an upper convex structure which is wide in the bottom and narrow in the top.

The upper-convex structure punched in the middle of the plate could be a cone frustum or multi-faceted pyramid frustum structure, on the top or side surface of which a LED circuit board can be placed. The upper-convex structure punched in the middle of the plate could also be a semi-sphere on which several cavities are further punched, and among which preset distances are set.

Step (1) further includes: Blank the whole plate to a sunflower shape, on which several fixed orifices for the circuit board and some wire holes are punched.

Step (3) further includes: Place the extended workblank into the necking die. Shapes of the side wall of the die should be consistent with the shape of the external wall of the predesigned lamp-housing-type heat-sink. Push down the work blank by push rod from the top, and the necking down step will be finished when the bottom of the housing contacts the bottom of the necking die.

The method also includes:

(4) at least one of oxidize, paint or electroplate the work blank for post and surface treatment.

Further, select the thickness of the high purity aluminum plate corresponding to the size of the LED lighting device. The larger the LED lighting device is, or the higher the radiation power of the LED is, the thicker the high purity aluminum plate will be.

The lamp-housing-type heat-sink in a lighting device for heat radiation is made monolithically by extending aluminum plate with a thickness of 0.5 mm to 5 mm and an aluminum content of above 95%. The lamp-housing-type heat-sink is hollow and composed of a heat-sinking surface and a housing body. Surface contact structure between the heat-sinking surface and a circuit board is formed. On the housing body, several radiating holes are set to form heat dissipation channels.

Preferably the radiating holes on the housing body are strip holes arranged along the external wall of the housing in parallel and radial directions. The housing body is a frustum, which narrows down from the end contacted with the circuit board to the other end.

An LED lighting device of the present invention includes an optical glass, a lamp-housing-type heat-sink, a circuit board, and an LED driving device, wherein the lamp-housing-type heat-sink is made monolithically from extending aluminum plate with a thickness of 0.5 mm to 5 mm and an aluminum content of above 95%, the lamp-housing-type heat-sink is hollow and composed of a heat-sinking surface and a housing body, and a surface contact structure between the heat-sinking surface and a circuit board is formed. On the housing body, several radiating holes are set to form heat dissipation channels.

The optical glass is set in the front end of the lamp-housing-type heat-sink and the LED driving device is set within or in the back end of the lamp-housing-type heat-sink.

The LED lighting device also includes a power housing within which a hollow cavity is set. The LED driving device is set within the hollow cavity of the power housing and the hollow cavity of the power housing is filled with glue of high heat conductivity and excellent insulation.

Preferably, in heat dissipation channel I, heat is conducted to the heat-sinking surface through the contact between the circuit board and the heat-sinking surface, from which heat is dissipated through the heat-radiating holes.

Preferably, in heat dissipation channel II, heat is dissipated from the LED driving device and then through the heat-radiating holes.

The two heat dissipation channels I and II are independent from each other.

In heat dissipation channel I, heat is dissipated through the heat convection between the surface of the housing and air, and the heat dissipation holes can ensure a smooth convection to enhance heat dissipation. In heat dissipation channel II, heat is to be dissipated from the LED driving device and through the high heat conductive glue to the surface of the power housing, and then heat is dissipated through heat convection between the surface of the housing and air. The heat dissipation holes can ensure a smooth convection of air and therefore enhance heat dissipation. The two channels can conduct heat to air smoothly and prevent them from accumulating within the lamp, which leads to excellent heat dissipation. Moreover, the two channels are independent from each other, and have no influence with each other.

The optical glass can be dodging optical glass or secondary grading optical glass, which could be fixed with screw or glue-pasted on the lamp-housing-type heat-sink. The circuit board is a module with flat bottom which contacts the heat-sinking surface of the lamp-housing-type heat-sink. Preferably, the two surfaces are painted with silicone grease with high conductivity.

A second method for manufacturing a lamp-housing-type heat-sink in an LED lighting device includes the following steps:

(1) Blank: take an high purity aluminum plate with a thickness of 0.5 mm to 5 mm and an aluminum content of above 95% according to the pre-designed size and blank the plate to external profile needed by the housing;

(2) First spin: spin the high purity aluminum plate into an open hollow piece. The size of the open end of the work blank should not be smaller than the one of the closed end after spinning;

(3) Second spin: spin the work blank processed above to reduce the diameter of the open end and spin the open end into the predesigned radian;

(4) Blank: Blank the side surface of the work blank processed above to get hollow high purity aluminum housing.

Between Step (1) and Step (2), the method includes:

First type punch forming: in the middle of the plate, punch out a sinking area to contact the surface of the circuit board, and form in the sinking area an abutted surface that could tightly fit the LED circuit board.

Preferably, between Step (1) and Step (2), the method also includes: second type punch foaming: the upper convex structure which is wide in the bottom and narrow in the top is punched in the middle of the plate.

The upper-convex structure punched in the middle of the plate is a cone frustum or multi-faceted pyramid frustum structure, on the top or side surface of which a LED circuit board could be placed. The upper-convex structure punched in the middle of the plate could also be a semi-sphere on which several cavities are punched to place the LED circuit board.

Compared with the existing technologies, the present invention has the following advantages:

First, the lamp-housing-type heat-sink in an LED lighting device is made monolithically by extending a high purity aluminum plate with a thickness of 0.5 mm to 5 mm and an aluminum content of above 95%. This can achieve the same and even better heat diffusion effect with ⅓ to ⅕ of the materials required by die-cast aluminum, and the cost will only be ½ to ⅓ of that required by die-cast aluminum. The heat conductivity of the high purity aluminum plate with aluminum content of above 95% is over 230 W/(m·K), contributing to a higher heat dissipation efficiency compared with die-cast aluminum and sectional aluminum. Moreover, the weight of the lighting device made in the lamp-housing-type heat-sink of the present invention is less than half of one having a die-cast housing. Because the present invention requires less material consumption, costs are lowered. Therefore, the LED lighting device of the present invention is of lower price, lighter weight, and wider application, namely that it can be applied to lighting devices of various models and types.

Second, the circuit board and lamp-housing-type heat-sink contact each other through a tightly contacted surface. The heat generated by the circuit board can be rapidly dissipated into air through the high purity aluminum plate of high heat conductivity, which contributes to excellent heat dissipation efficiency.

Third, the LED luminescent lamp and the LED driving device are separated to prevent heat accumulation. Namely, in the heat dissipation channel I, heat is conducted to the heat-sinking surface through the contact surface between the circuit board and the heat-sinking surface. Heat is then is dissipated from the heat-sinking surface through the heat-radiating holes. In heat dissipation channel II, heat is dissipated from the LED driving device and through the heat-radiating holes. These two heat dissipation channels I and II are independent from each other, and have no influence with each other.

Also, the lighting effect of the LED luminescent lamp is as high as above 100 lm/W, and the electric energy conversion efficiency can be over 90%. This can save more electric energy in comparison with a common filament lamp. An LED luminescent lamp of 7 to 9 W can reach the luminance of traditional filament lamps of over 50 W.

DETAILED DESCRIPTION OF THE PREFERRED EMBODIMENTS

Hereinafter the present invention will be described in detail referring to the attached drawings.

Figure 1:
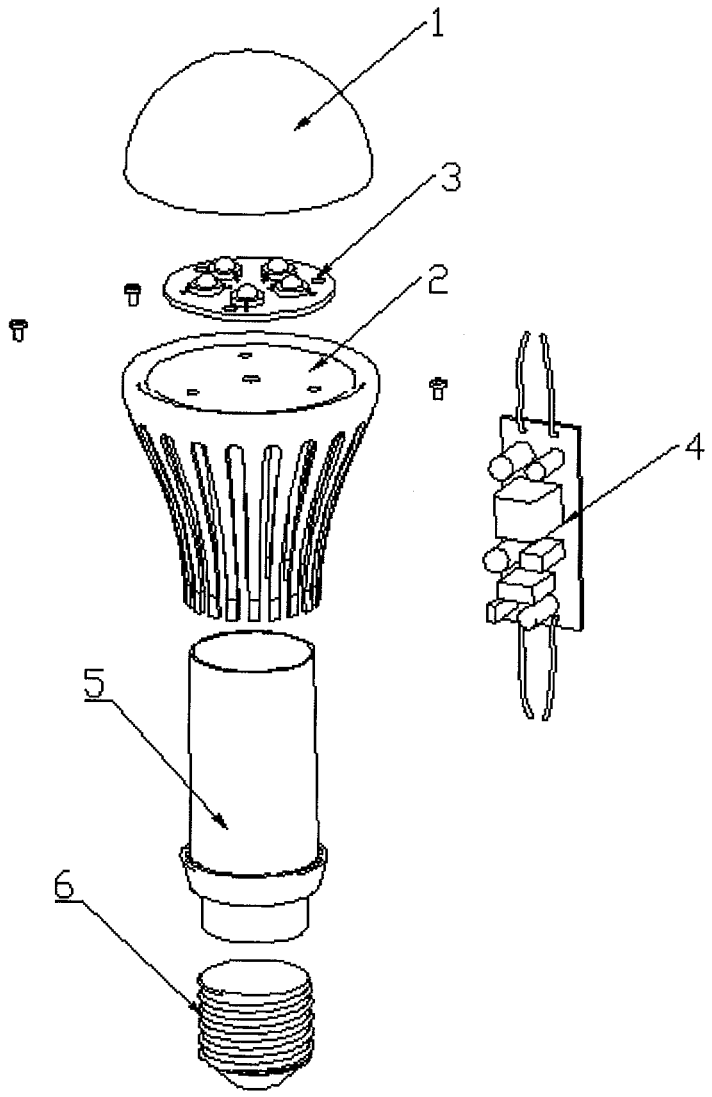
FIG. 1 is an exploded view of an LED lighting device.

With reference to FIG. 1, an LED light device is illustrates, which includes an optical glass 1, a lamp-housing-type heat-sink 2, a circuit board 3, an LED driving device 4, a power housing 5, and a lamp base 6.

The optical glass 1 is preferably made of materials with high light transmissivity such as PC, PMMA, glass, or organic glass. It is used for secondary grading and dodging according to the lighting device types. Secondary-grading optical glass reallocates the light of LED luminescent lamp beads or integrated packaged LED lighting module and makes the light spot on the receiving surface in round, rectangle and any other needed shapes. Secondary-grading optical glass has one or more grading units. Dodging optical glass diverges evenly the light of LED luminescent lamp beads, usually by rough treatment of the surface of the dodging optical glass or adding dodging materials in lens materials. The optical glass 1 could be fixed with screw or glue-pasted on the lamp-housing-type heat-sink 2.

The lamp-housing-type heat-sink 2 is made of a high purity aluminum plate with a thickness of 0.5 mm to 5 mm and an aluminum content of above 95%. A traditional LED bulb or LED PAR lamp usually adopts a die-cast aluminum lamp-housing-type heat-sink, of which the heat conductivity of die-cast aluminum is only about 95 W/m·K. The present invention creatively uses a high purity aluminum plate together with a deep extending process to make an LED lamp-housing-type heat-sink. Heat conductivity of high purity aluminum is about 237 W/m·K, which is 2.5 times that of common die-cast aluminum. Therefore, the present invention can achieve the same and even better heat diffusion effect using only ⅓ to ⅕ of the materials used by conventional die-cast aluminum. The cost of the present invention is only ½ to ⅓ of that of conventional die-cast aluminum. The weight of the lighting device made in the lamp housing of the present invention is also less than half of the conventional one made of die-cast housing.

For example, the lighting industry usually adopts high purity aluminum plates of 1050, 1060 and 1070. The heat conductivity of pure aluminum is 237 W/m·K. Aluminum content of 1050 aluminum plate is 99.5% with heat conductivity of 209 W/m·K. Aluminum content of 1060 aluminum plate is 99.6% and the heat conductivity of it should be between 1050 aluminum plate and 1070 aluminum plate. Aluminum content of 1070 aluminum plate is 99.7% with heat conductivity of 226 W/m·K. The heat conductivity of high purity aluminum plate is greatly higher than that of the sectional aluminum which is about 209 W/m·K and much higher than that of die-cast aluminum which is about 95 W/m·K. Therefore, the heat-sink of the present invention provides an excellent heat dissipation effect.

Figure 2:
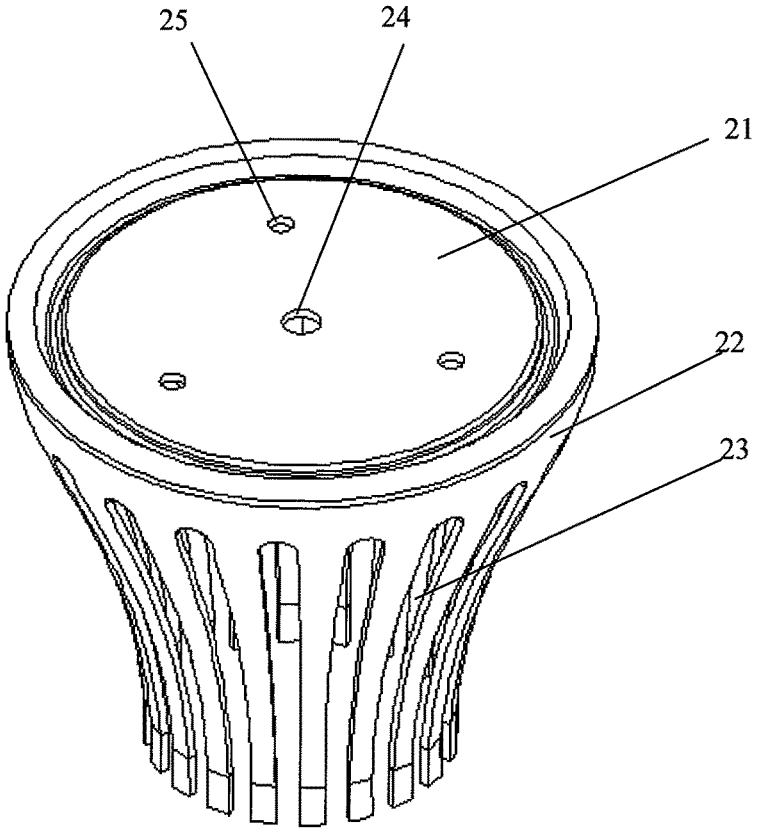
FIG. 2 is a diagrammatic drawing of the structure of a lamp-housing-type heat-sink.

For a traditional die-cast aluminum LED bulb or PAR lamp, the circuit board and the lamp-housing-type heat-sink usually contact with each other with only a small area. Heat cannot be transmitted smoothly from the circuit board to the lamp-housing-type heat-sink on this arrangement. Unlike the conventional art, the lamp-housing-type heat-sink 2 of the present invention is composed of a heat-sinking surface 21 and a housing body 22, and the heat-sinking surface 21 and the circuit board 3 forms a contact surface structure. On the housing body 22, several radiating holes are formed which could provide a heat dissipation channel. The radiating holes set on the housing body 22 are strip holes 23 for heat dissipation arranged along the external wall of the housing in both parallel and radial directions. In addition, the housing body 22 is a frustum, which narrows down from the end contacted with the circuit board 3 to the other end. The heat-sinking surface 21 is flat surface or a sinking flat surface used to contact the circuit board 3. On the heat-sinking surface 21, several circuit board fixed orifices 25 and a wire hole 24 are set as is shown in FIG. 2.

The flat or sinking flat heat-sinking surface 21 is designed to tightly contact the bottom of the flat circuit board 3 and between them silicone grease of high heat conductivity can be pasted or not. Heat from the circuit board 3 can be rapidly transmitted to the lamp-housing-type heat-sink 2, achieving excellent heat dissipation efficiency. Parts of the materials surrounding the housing body 22 of the lamp-housing-type heat-sink 2 have been cut off to get a hollow housing, namely set the heat dissipating stripe hole 23. In this way, heat of the lamp-housing-type heat-sink 2 can form a smooth heat circulation channel within and outside of the hollow lamp-housing-type heat-sink. The lamp-housing-type heat-sink 2 is formed from a metal plate of large superficial area by deep extending. Fixing the circuit board 3 on the lamp-housing-type heat-sink 2 can make full use of the large area of the housing for effective heat dissipation, and rapidly transmit the heat generated from the circuit board 3 LED to the lamp-housing-type heat-sink 2 and then to air.

The circuit board 3 is a lighting module with a flat bottom, the smooth surface of which is tightly fitted with the fixed surface for the circuit board of the lamp-housing-type heat-sink 2. Silicone grease of high heat conductivity can be pasted or not on the contacting surface of the two. It can be a PCBA plate by welding LED luminescent lamp beads on the circuit board 3 with excellent heat conductivity, or an integrated packaged LED lighting module. Preferably, the circuit board 3 is made of materials of high heat conductivity so that the heat generated from the LED chip can be rapidly transmitted to the circuit board 3 to prevent heat accumulation surrounding the LED chip. The circuit board is also tightly contacted with the housing of large superficial area. Therefore, the heat can be rapidly be transmitted to air. A smooth and highly efficient heat conducting channel is formed from the internal lamp to air.

The LED driving device 4 is an efficient driving device, with an input line connected to the anode and cathode of the lamp base 6 and an output line connected to the anode and cathode of the circuit board 3. It is placed in the hollow cavity of the power housing 5, within which glue of high heat conductivity and excellent insulation has been filled. The glue can rapidly transmit the heat generated by the heating component in the power and thus prevent heat from accumulating surrounding the heating elements. Another end of the power housing is used to fix the lamp base 6.

The power housing 5, made of plastics, is a round hollow housing and used for fixing the lamp-housing-type heat-sink 2 and the lamp base 6. In its hollow cavity, the LED driving device 4 is placed and glue of high heat conductivity and excellent insulation has been filled. In the heat dissipation channel I, heat is conducted to the heat-sinking surface through the connecting between the circuit board and the heat-sinking surface thereafter is dissipated through the radiating holes. In the heat dissipation channel II, heat is dissipated from the LED driving device and then through the radiating holes. The two heat dissipation channels are independent from each other.

The lamp base 6 is usually a common one like E27 screw base. It can also be customized according to actual demand.

Hereinafter the method for manufacturing the first lamp-housing-type heat-sink is introduced.

Figure 3A:
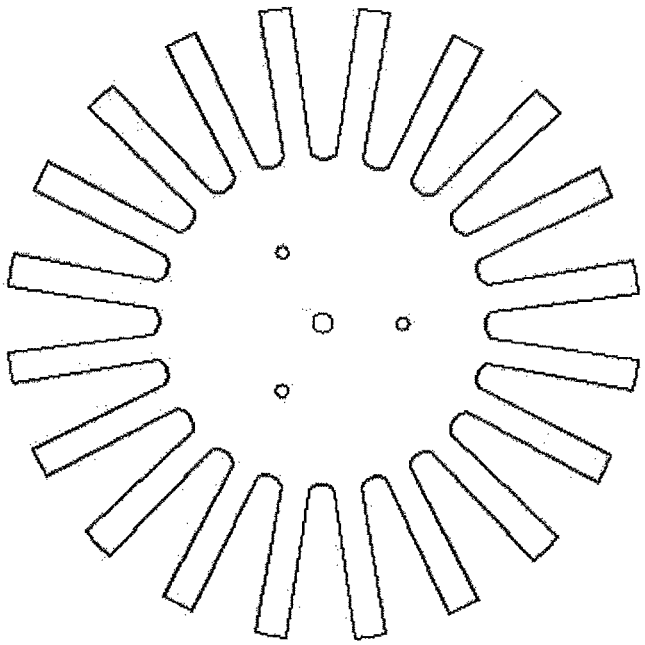
FIG. 3A is a diagrammatic drawing of a workblank after blanking.
Figure 3B:
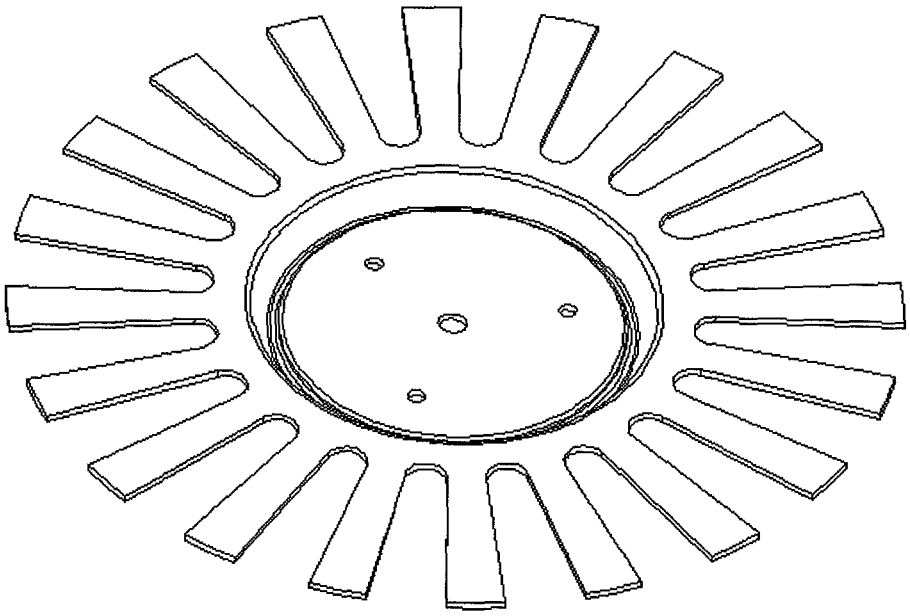
FIG. 3B is a diagrammatic drawing of a first type workblank after punch forming.

The manufacturing process of the lamp-housing-type heat-sink (2) is mainly as below:

(1) Blank (FIG. 3A). Blank to cut the part not needed and to obtain the contour needed. As shown in FIG. 3A, blank a piece of aluminum plate into a sunflower shape, on which some circuit board fixed orifices and a wire hole are also punched. In addition, select the thickness of the high purity aluminum plate according to the size of the LED lighting device. The larger the LED lighting device is or the higher the heating efficiency of the LED is, the thicker the high purity aluminum plate should be. The higher thickness leads to larger sectional area and higher speed of heat transmission and, thus, achieves higher heat dissipation efficiency. The higher the requirements are for heat dissipation of the LED lighting device, the thicker the plate should be.

Figure 3C:
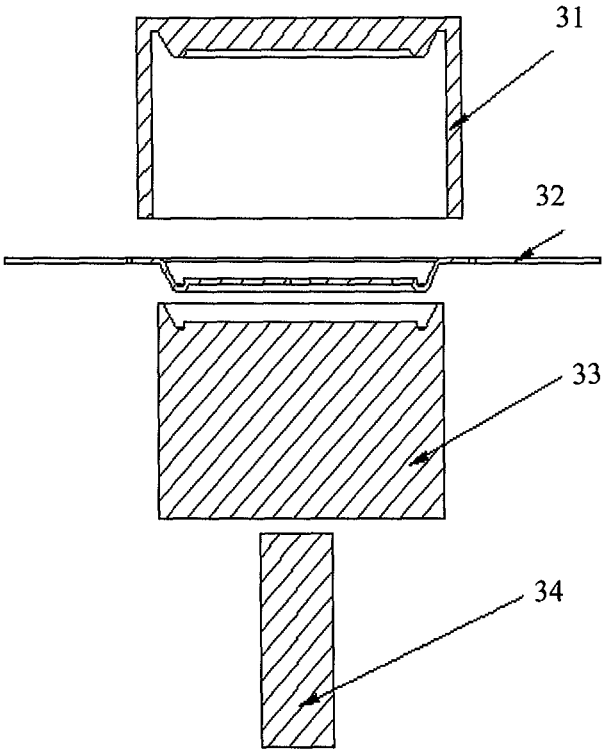
FIG. 3C is a diagrammatic drawing of a workblank after extending.
Figure 3D:
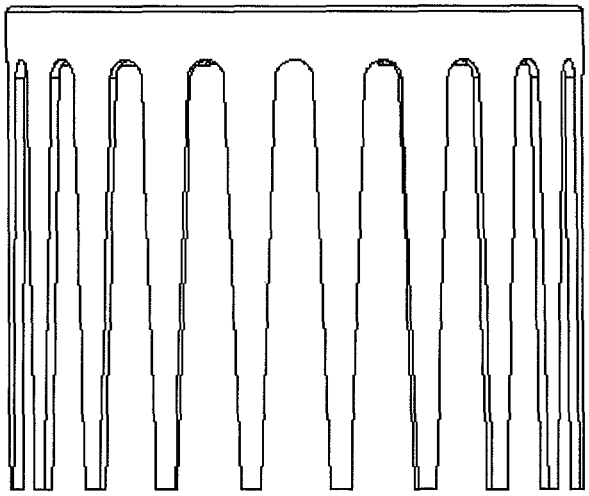
FIG. 3D is a diagrammatic drawing of the extending process.
Figure 3E:
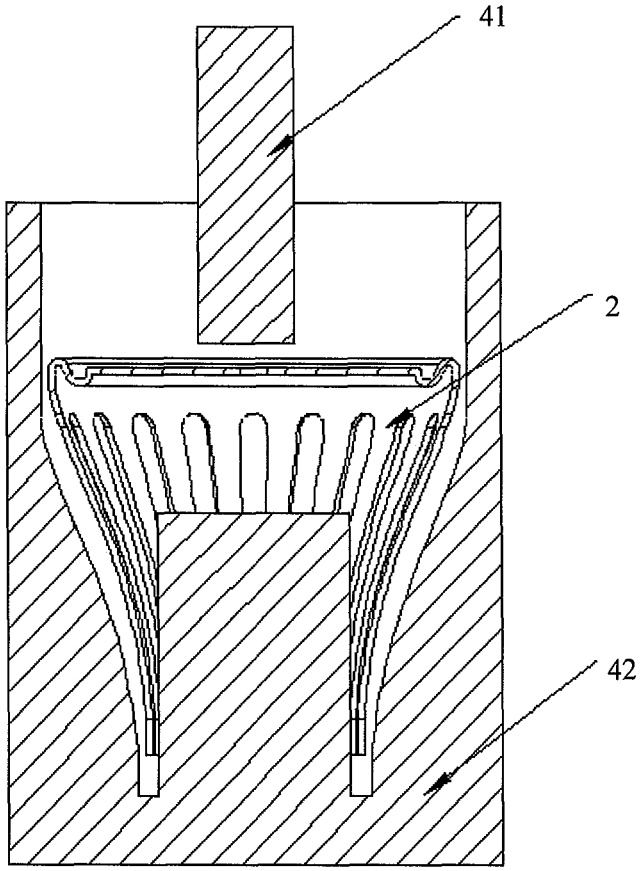
FIG. 3E is a diagrammatic drawing of the necking process.
Figure 3F:
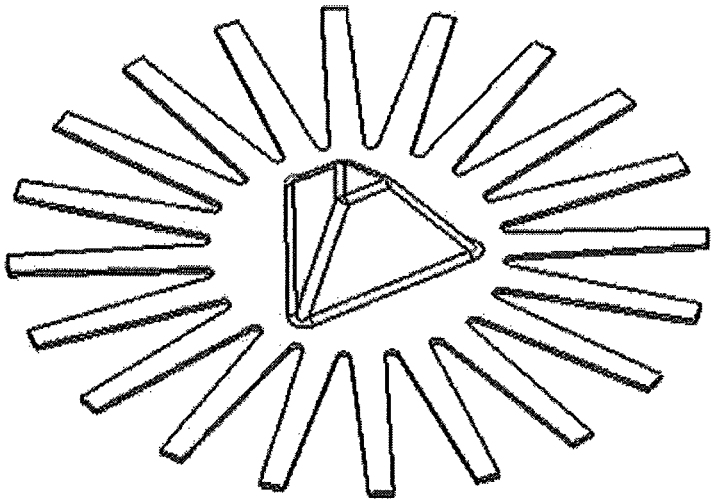
FIG. 3F is a diagrammatic drawing of a second type workblank after punch forming.
Figure 3G:
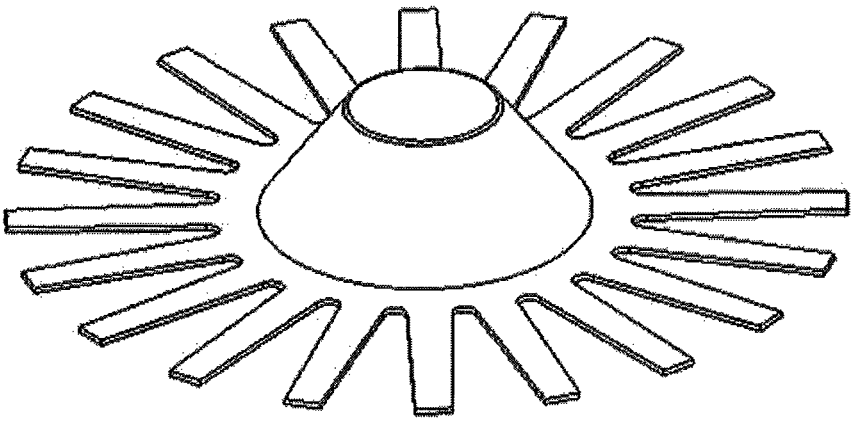
FIG. 3G is a diagrammatic drawing of a third type workblank after punch forming.
Figure 3H:
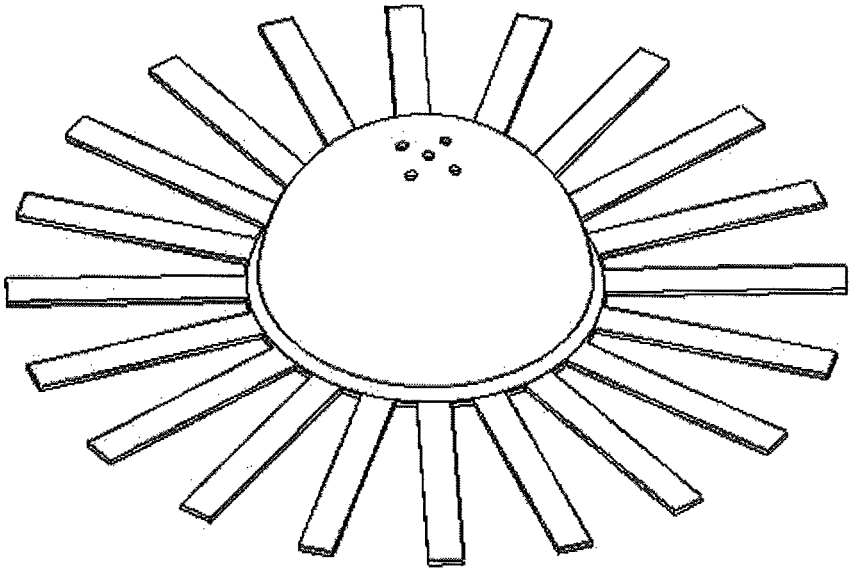
FIG. 3H is a diagrammatic drawing of a fourth type workblank after punch forming.
Figure 3I:
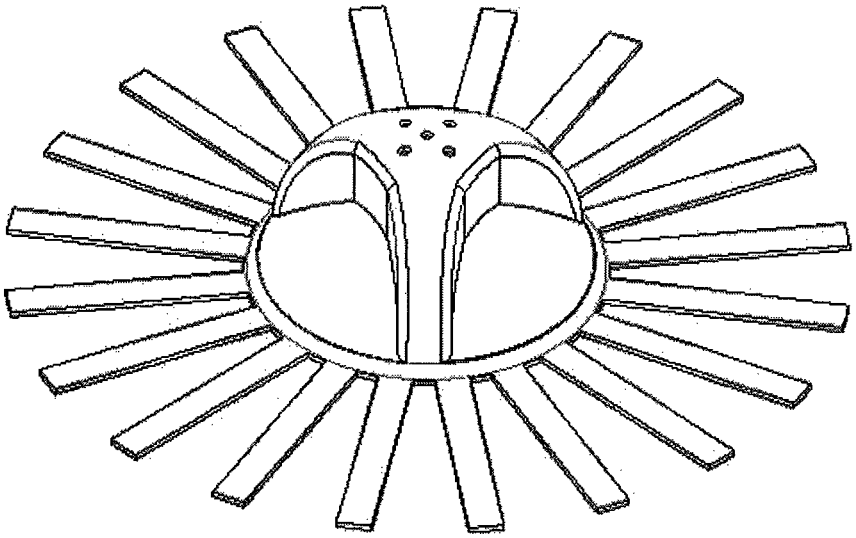
FIG. 3I is a diagrammatic drawing of the workblank after the second punch of FIG. 3H.

(2) Punch forming (as shown in FIGS. 3B and 3F-3I). In the middle of the plate, punch out the shapes needed with a forming die. The shape could be a sinking area that contacts with the circuit board surface, a wide-bottom-narrow-top upper-convex structure, or a semi-sphere. Second punch can be adopted as per the specific demand for the structure. For example, FIG. 3I shows the multi-cavity structure punched based on the semi-sphere shown in FIG. 3H. Different forming dies can make various structures needed.

(3) Extending (as shown in FIG. 3C). Extend the metal plate into an open hollow piece, as shown in FIG. 3D. The obtained workblank is a cylinder with equal diameter in the two ends. As shown in FIG. 3D, fix the die 31 and fit the workblank 32 to be extended on the top surface of the extending die 33 and push the extending die 33 and the workblank 32 to be extended into the die 31 with a push rod 34. The workblank will then be a cylinder with equal diameter in the two ends. The above description is only one realization of extending and the method should not be used for limiting the scope of the invention.

(4) Necking down (as shown in FIG. 3E). Neck down the open end of the cylinder workblank and shrink it into predesigned radian. As shown in FIG. 3E, place the extended workblank into the necking die 42, the side wall of which is consistent with the shape of the external wall of the designed lamp-housing-type heat-sink 2. Push down the workblank from the top with a push rod 41 and, when, the bottom of housing contacts the bottom of the necking die 42, the necking down step is finished.

(5) Post-processing and surface treatment. After necking down, oxidize, paint, or electroplate the workblank for surface treatment. The surface treatment can also be exempted.

The manufacturing method of the second lamp-housing-type heat-sink is mainly as below:

For the following method, steps 3, 4, and 5 are the main steps, and the sequence thereof cannot be changed.

Figure 4A:
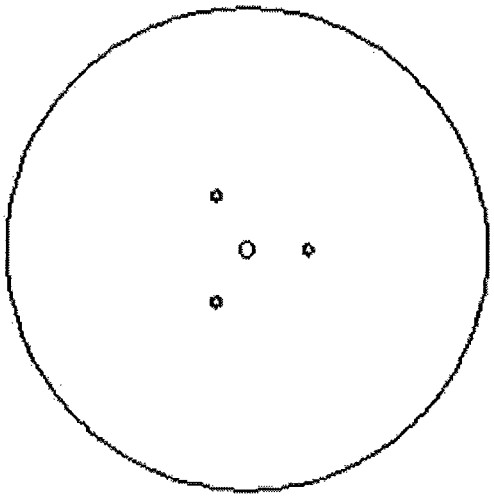
FIG. 4A is a diagrammatic drawing of a workblank after blanking.

(1) Blank (as shown in FIG. 4A). Blank a piece of aluminum plate to cut the part not needed and to get the contour needed. As shown in FIG. 4A, some circuit board fixed orifices and a wire hole are punched on the plate.

Figure 4B:
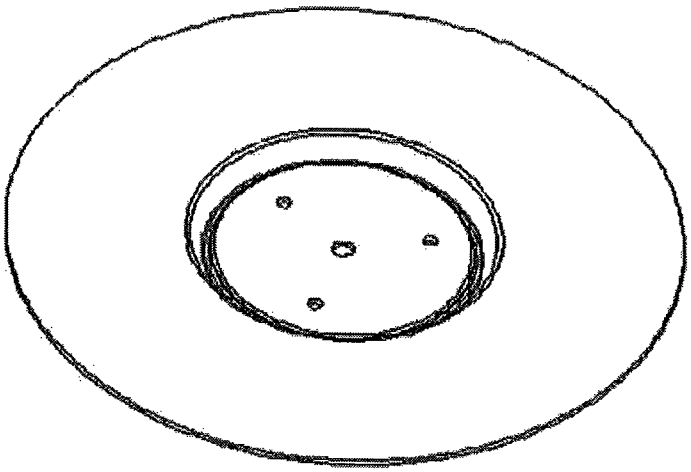
FIG. 4B is a diagrammatic drawing of a workblank after punch forming.

(2) Punch forming ((as shown in FIG. 4B). The part on the lamp housing 2 for fixing the circuit board and the optical glass is a sinking area, which is punched with a forming die into shapes needed. The shape could be a sinking area that contacts the circuit board surface, a wide-bottom-narrow-top upper-convex structure, or a semi-sphere. Second punch can be adopted as per the specific structure demand.

Figure 4C:
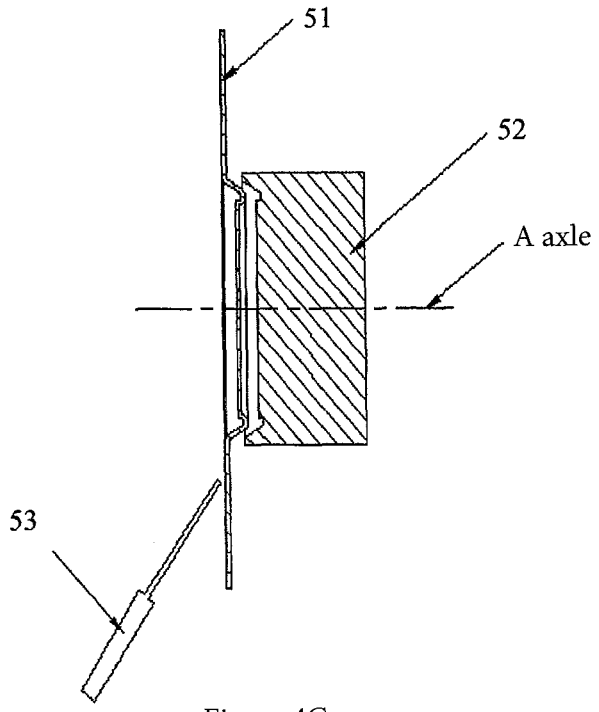
FIG. 4C is a diagrammatic drawing of the first spinning process.

(3) First spin (as shown in FIG. 4C). Spin the metal plate into an open hollow piece. The size of the open end of the spin workblank should be larger or equal to the size of the close end. As shown in FIG. 4C, the bottom of the spinning workblank 51 tightly fits the top surface of the spin die 52. Both the spinning workblank 51 and the spin die 52 rotate rapidly together along the A axle. After that, withstand the spinning workblank 51 with a push rod 53 until the spinning workblank 51 is completely fitting with the spin die 52. In this way, the spinning workblank is made into open hollow piece.

Figure 4D:
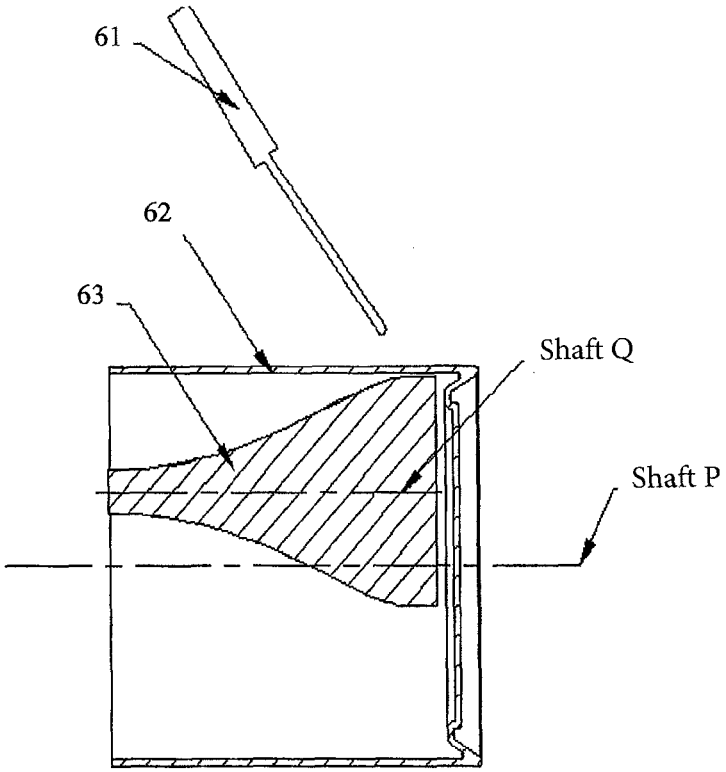
FIG. 4D is a diagrammatic drawing of the second spinning process.

(4) Second spin (as shown in FIG. 4D). Further treat the workblank processed above with a special spinning process to neck down the open end and shrink it into a predesigned radian. As shown in FIG. 4D, the radian of the side surface of the eccentric spinning die 63 is the right one needed by the side surface of the high purity aluminum housing. The workblank 62 rotates along its center shaft P and the eccentric spinning die 63 rotates along its center shaft Q as well as the eccentric shaft P. A push rod 61 is used to make the side wall of the workblank 62 tightly fit the side wall of the eccentric spinning die 63. Take out the product after spinning. The special spinning process is aimed to take out the product smoothly from the die.

(5) Blank. Blank the side surface of the workblank processed above to cut the part not needed and to get a hollow high purity aluminum housing.

(6) Post-processing and surface treatment. After being necked down, the workblank is oxidized, painted, or electroplated for surface treatment. The surface treatment can also be exempted.

Embodiment 1

Figure 5:
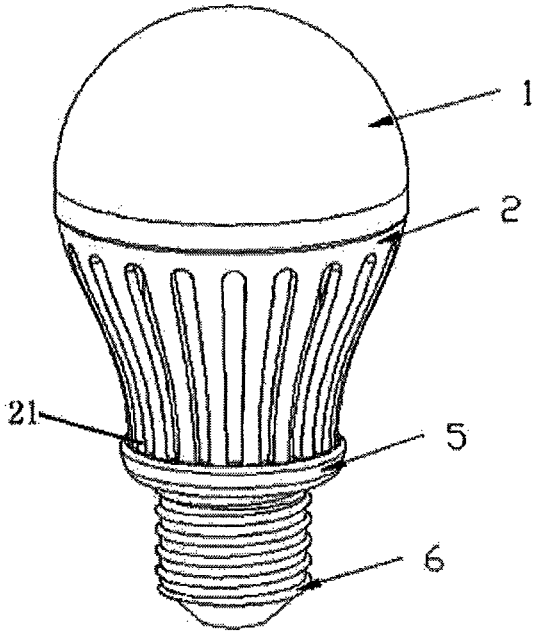
FIG. 5 is an LED bulb diagrammatic drawing of Embodiment 1.

In FIG. 5, an LED bulb diagrammatic drawing is shown. The LED bulb is a bulb of 220 v AC input and E27 lamp base, and can replace a traditional 220 v input filament lamp. Put the input line of the LED driving device of 220 v AC input and DC output through the power housing 5 and weld the input line to the positive and negative electrodes of the E27 lamp base. Then, press the E27 lamp base to the power housing 5. Plug the LED driving device 4 into the hollow cavity of the power housing 5 and fill glue of excellent heat conductivity. Wait for a while until the glue is solidified. Then, put the output line of the LED driving device 4 through the wire hole of the lamp-housing-type heat-sink 2, plug the needle 21 of the lamp-housing-type heat-sink 2 into the corresponding hole provided outside of the power housing 5, and fix with glue. Then, fix the circuit board 3 with screw on the metal housing and weld the output line of the LED driving device 4 to the circuit board 3. Lastly, fix the semi-spherical dodging optical glass 1 with glue on the lamp-housing-type heat-sink 2. The assembly is completed.

The LED bulb has a household AC input of 220V and 50 Hz, and a standard E27 lamp base, making it able to replace the existing household filament lamps.

Embodiment 2

Figure 6:
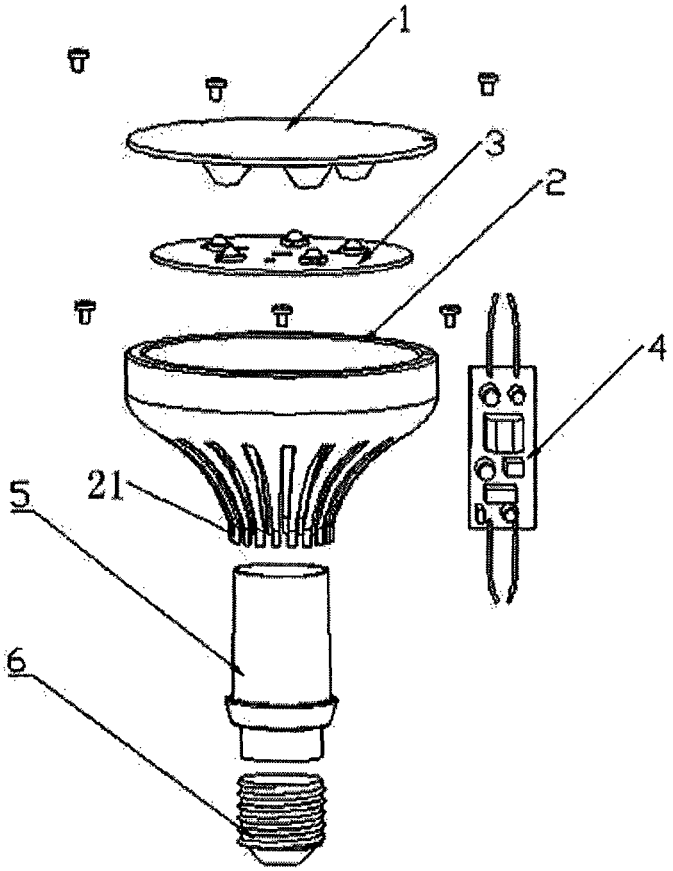
FIG. 6 is an exploded view of an LED PAR lamp of Embodiment 2.
Figure 7:
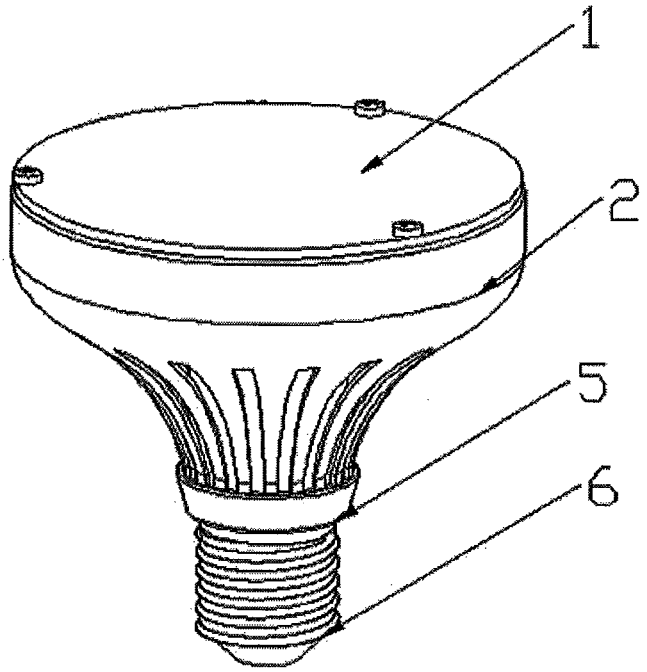
FIG. 7 is an LED PAR lamp diagrammatic drawing of Embodiment 2.

In FIGS. 6 and 7, an LED PAR lamp diagrammatic drawing is shown. The LED PAR lamp is a PAR lamp of 220 v AC input and E27 lamp base. Put the input line of the LED driving device of 220 v AC input and DC output through the power housing 5 and weld the input line to the positive and negative electrodes of the E27 lamp base. Then, press the E27 lamp base to the power housing 5. Plug the LED driving device 4 into the hollow cavity of the power housing 5 and fill glue of excellent heat conductivity. Wait for a while until the glue is solidified. Then, put the output line of the LED driving device 4 through the hole for wire of the lamp-housing-type heat-sink 2, plug the needle 21 of the lamp-housing-type heat-sink 2 into the corresponding hole provided outside of the power housing 5, and fix with glue. Fix the circuit board 3 with screw on the metal housing and weld the output line of the LED driving device 4 to the circuit board 3. Lastly, fix the condensing optical glass 1 with glue on the lamp-housing-type heat-sink 2. The assembly is completed.

The LED PAR lamp has a household AC input of 220V and 50 Hz, and a standard E27 lamp base, making it able to replace the existing household PAR lamp.

Embodiment 3

MR16 Execution Example

Figure 8:
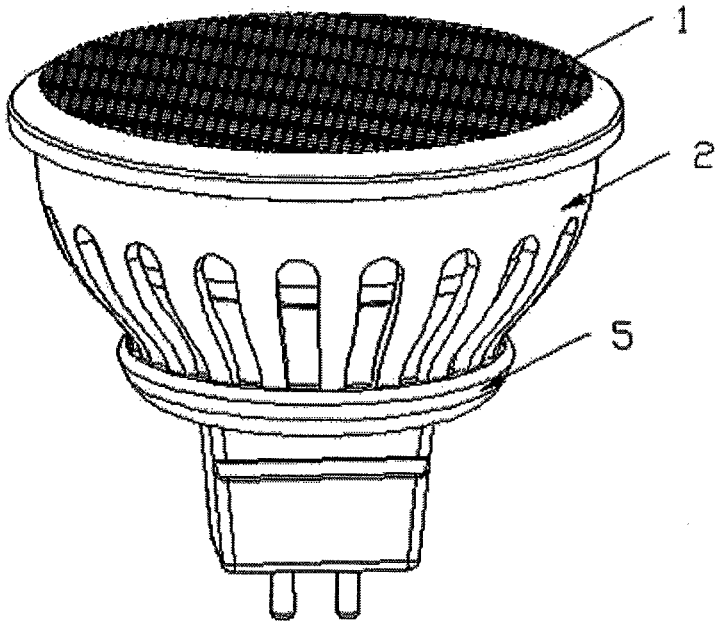
FIG. 8 is an MR16 diagrammatic drawing of the LED of Embodiment 3.
Figure 9:
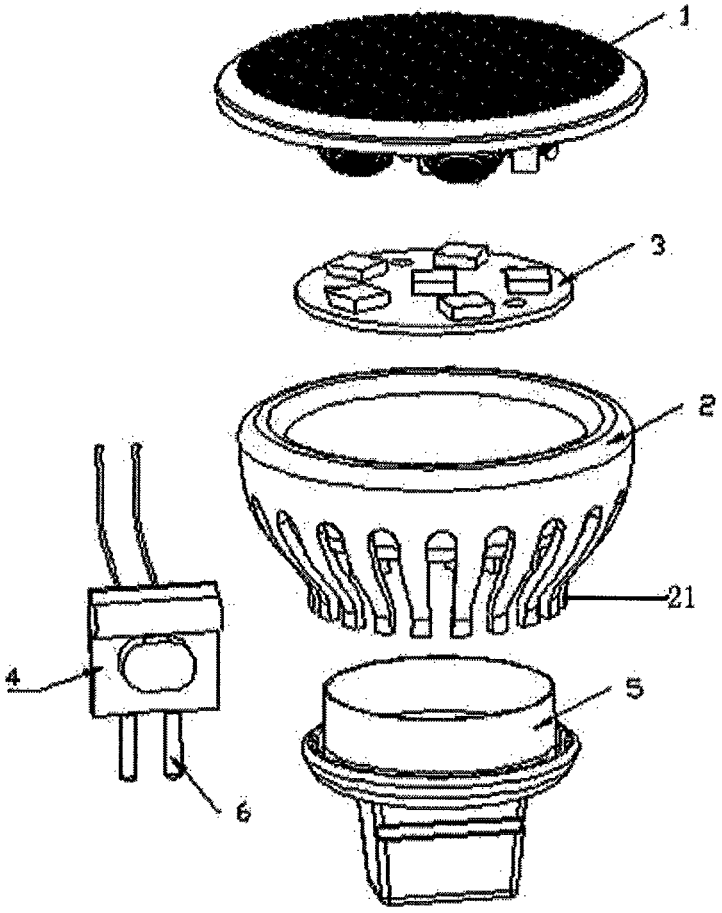
FIG. 9 is an MR16 explosive view of the LED of Embodiment 3.

FIGS. 8 and 9 are diagrammatic drawings of an LED MR16. The LED MR16 is of 12 v input and GU5.3 lamp base, and can replace a traditional 12 v input MR16 spotlight. Six LED luminescent lamp beads are welded on the circuit board of the MR16. On the optical glass 1, there are six secondary dodging units which focus the light of each luminescent lamp bead. The input end of the LED driving device 4 has two metal contact pins, between which the distance is 5.3 mm. For assembly, put the LED driving device 4 into the hollow cavity of the power housing 5 and plug the contact pins into the holes with a distance of 5.3 mm on the power housing 5. Then, fill in the hollow cavity of the power housing 5 with glue of high heat conductivity and wait until the glue is solidified. Then, put the output line of the LED driving device 4 through the wire hole of the lamp housing 2, plug the needle 21 of the lamp housing 2 into the holes provide outside of the power housing 5, and fix with glue. Then, fix the circuit board 3 with screw on the metal lamp housing 2 and weld the output line of the LED driving device 4 to the circuit board 3. Lastly, fix the condensing optical glass 1 on the lamp housing 2 with screw or glue to finish the assembly.

The LED MR16 has a 12 v DC input and standard GU10 lamp base, and can replace traditional MR16 using halogen bulbs.

Embodiment 4

Figure 10:
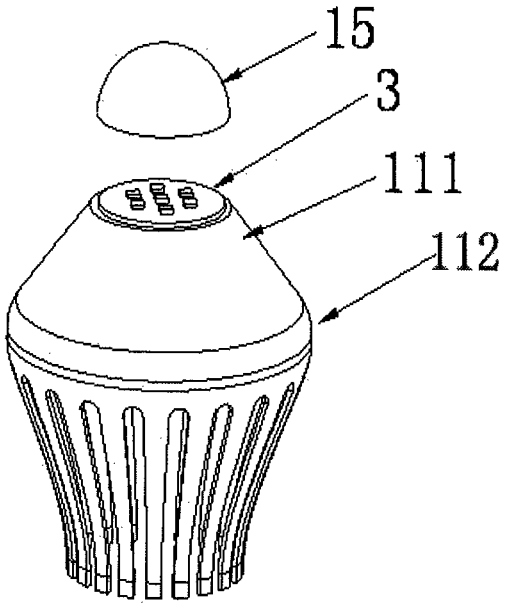
FIG. 10 is a diagrammatic drawing of the bulb heat dissipation housing structure of Embodiment 4.

As shown in FIG. 10, this embodiment is mostly similar to Embodiment 1, and therefore the same parts between the two will not be described in detail. The difference between the two is that the housing heat-sink 2 further includes a chip mounting base 111 on the top and a heat dissipation supporter 112 at the bottom. The chip mounting base 111 is connected to the heat dissipation supporter 112. The two can be integrated or separated. They can be connected through screw or snap joints. The chip mounting base 111 is an upper-convex frustum (cone frustum, multi-faceted pyramid frustum, or any other similar structure). The circuit board 3 is set on the top of the chip mounting base 111 with a hemispherical fluorescent powder cover 15 above. The fluorescent powder cover 15 is painted with fluorescent powder on the inside or outside surfaces, or the cover itself is mixed with fluorescent powder.

Embodiment 5

Figure 11A:
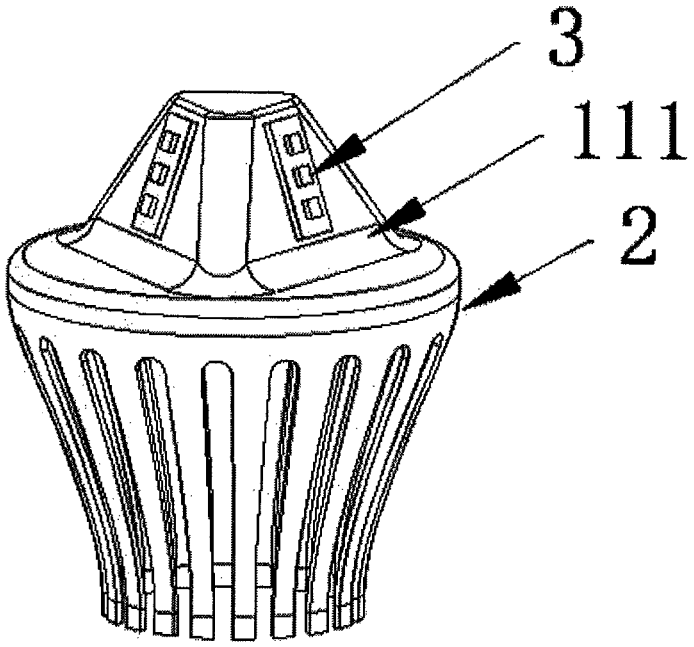
FIG. 11A is a diagrammatic drawing of the bulb heat dissipation housing structure of Embodiment 5.
Figure 11B:
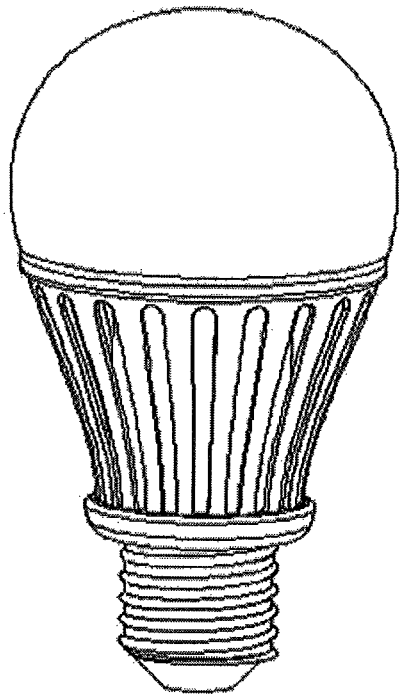
FIG. 11B is a diagrammatic drawing of the bulb of Embodiment 5.

As shown in FIGS. 11A and 11B, this embodiment is mostly similar to Embodiment 4, and therefore the same parts between the two will not be described in detail. The difference between the two is that the upper chip mounting base 111' of the housing heat-sink is a multi-faceted pyramid frustum. Several circuit boards 3 are placed respectively on the side surfaces of the chip mounting base 111'. The fluorescent powder cover is removed and fluorescent powder particles are directly painted on the LED chips.

Embodiment 6

Figure 12A:
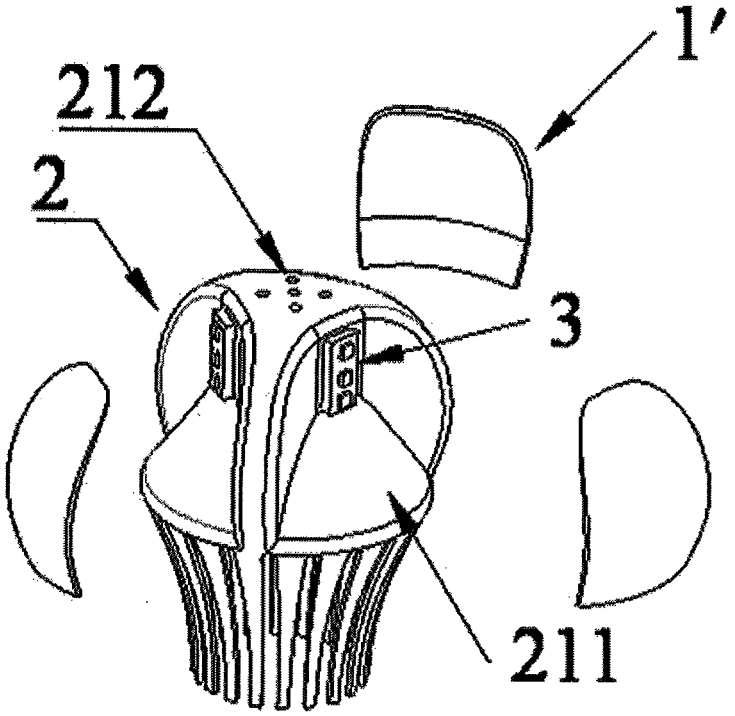
FIG. 12A is a diagrammatic drawing of the bulb heat dissipation housing structure of Embodiment 6.
Figure 12B:
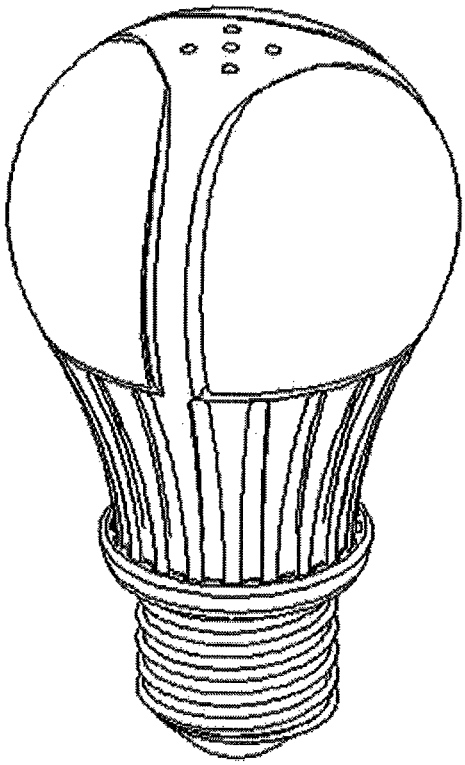
FIG. 12B is a diagrammatic drawing of the bulb of Embodiment 6.

As shown in FIGS. 12A and 12B, this embodiment is mostly similar to Embodiment 1, and therefore the same parts between the two will not be described in detail. The difference between the two is that the housing heat-sink 2 further comprises an upper part and a lower part connected together. In the upper part of the heat dissipating lamp housing 1, several cavities 211 are set in a lengthwise direction along the heat dissipating lamp housing 1. All of the cavities 211 can make a periphery of the upper part. Several LED circuit boards 3 are placed respectively within the cavities 211. Diffusers 1' are respectively set at the open of each cavity 211 (diffuser is a type of optical glass). Side walls of the cavities 211 of the housing heat-sink 2 are not contact with each other but with spaces reserved. Therefore, multiple heat dissipation channels are set among the cavities 211. Moreover, the cavities 211 are made of metal materials, contributing to higher heat dissipation efficiency.

The details disclosed above are only some embodiments of the present invention. However, the protection scope of the present invention should not be limited to the above description. Any alteration that the technicians of the field may come up with should be within the scope of protection of the present invention.

What is claimed:

1. A method for manufacturing a lamp-housing-type heat-sink in an LED lighting device, comprising the following steps:

(1) taking a high purity aluminum plate with a thickness of 0.5 mm to 5 mm and an aluminum content of above 95% as per an pre-designed size, and blanking the plate to an external profile needed by a housing;

(2) extending the plate into a hollow workblank having an open end, a closed end and a sidewall that extends from the open end to the closed end;

(3) putting the extended workblank into a necking die to neck the extended workblank down to a preset radian of the lamp-housing-type heat-sink such that the sidewall of the necked workblank is tapered towards the open end of the workblank.

2. The method for manufacturing a lamp-housing-type heat-sink in an LED lighting device of claim 1, wherein, between step (1) and step (2), the method further comprises:

in the middle of the plate, punching out a sinking area to contact with the surface of a circuit board, and forming, in the sinking area, an abutted surface that fits the LED circuit board.

3. The method for manufacturing a lamp-housing-type heat-sink in an LED lighting device of claim 1, wherein, between step (1) and step (2), the method further comprises:

in the middle of the plate, punching out an upper-convex structure that is wider at the bottom than at the top.

4. The method for manufacturing a lamp-housing-type heat-sink in an LED lighting device of claim 3, wherein the upper-convex structure punched in the middle of the plate is a cone frustum or multi-faceted pyramid frustum structure, on the top or side surface of which an LED circuit board is placed.

5. The method for manufacturing a lamp-housing-type heat-sink in an LED lighting device of claim 3, wherein the upper convex structure punched in the middle of the plate is a semi-sphere structure.

6. The method for manufacturing a lamp-housing-type heat-sink in an LED lighting device of claim 5, wherein several cavities are further punched on the semi-sphere structure with a preset distance therebetween; and the cavities are used to place an LED circuit board.

7. The method for manufacturing a lamp-housing-type heat-sink in an LED lighting device of claim 1, wherein step (1) further comprises:

blanking the whole plate to a sunflower shape, and punching a plurality of fixed orifices for a circuit board and a plurality of wire holes in the plate.

8. The method for manufacturing a lamp-housing-type heat-sink in an LED lighting device of claim 1, wherein step (3) further comprises:

placing the extended workblank into the necking die, wherein the shape of the sidewall of the die is consistent with the shape of an external wall of the predesigned lamp-housing-type heat-sink; and pushing down the workblank with a push rod from the top, wherein this step is finished when the bottom of the housing contacts the bottom of the necking die.

9. The method for manufacturing a lamp-housing-type heat-sink in an LED lighting device of claim 1, further comprising the step of:

(4) posting and surface treating the workblank using at least one of oxidation, paint, and electroplating.

10. The method for manufacturing a lamp-housing-type heat-sink in an LED lighting device of claim 1, comprising selecting the thickness of the high purity aluminum plate according to the size of the LED lighting device, wherein the larger the LED lighting device is, or the higher the radiation power of the LED is, the thicker the plate will be.

11. A lamp-housing-type heat-sink in a lighting device for heat radiation, wherein the lamp-housing-type heat-sink is made monolithically by extending a high purity aluminum plate with a thickness of 0.5 mm to 5 mm and an aluminum content of above 95%, the lamp-housing-type heat-sink is hollow and composed of a heat-sinking surface and a housing body, a surface contact structure is formed between the heat-sinking surface and a circuit board, a plurality of radiating holes are set on the housing body to form heat dissipation channels, and the housing body has an open end and a sidewall that extends from and is tapered towards the open end of the lamp-housing-type heat-sink.

12. The lamp-housing-type heat-sink of claim 11, wherein the radiating holes on the housing body are strip holes arranged along an external wall of the housing in parallel and radial directions.

13. The lamp-housing-type heat-sink of claim 11, wherein the housing body is a frustum, which narrows down from the end that contacts with the circuit board to the other end.

14. A method for manufacturing a lamp-housing-type heat-sink in an LED lighting device, comprising the following steps:

(1) taking a high purity aluminum plate with a thickness of 0.5 mm to 5 mm and an aluminum content of above 95% as per a pre-designed size, and blanking the plate to an external profile needed by a housing;

(2) first spinning the high purity aluminum plate into an open hollow piece, wherein a diameter of the open end of the workblank is not smaller than a diameter of the closed end after the first spinning;

(3) second spinning the workblank to reduce the diameter of the open end and spin the open end into a predesigned radian such that a sidewall of the workblank extends from the open end to the closed end and is tapered towards an open end of the workblank;

(4) blanking the side surface of the workblank to obtain a hollow high purity aluminum housing.

15. The method for manufacturing a lamp-housing-type heat-sink in an LED lighting device of claim 14, wherein, between step (1) and step (2), the method further comprises:

in the middle of the plate, punching out a sinking area for contacting with the surface of a circuit board, and forming an abutted surface in the sinking area that tightly fits the LED circuit board.

16. The method for manufacturing a lamp-housing-type heat-sink in an LED lighting device of claim 14, wherein, between step (1) and step (2), the method further comprises:

in the middle of the plate, punching out an upper-convex structure that is wider at the bottom than at the top.

* * * * *